United States Patent [19]

Terada et al.

[11] 4,353,979

[45] Oct. 12, 1982

[54] LIGHT-SENSITIVE SILVER HALIDE PHOTOGRAPHIC MATERIALS

[75] Inventors: Sadatugu Terada; Hideaki Arai, both of Hachioji; Kenji Itoh, Hino; Hiroshi Sugita, Hachioji; Katsumi Matsuura, Akigawa; Thuneo Wada, Sagamihara, all of Japan

[73] Assignee: Konishiroku Photo Industry Co., Ltd., Tokyo, Japan

[21] Appl. No.: 169,423

[22] Filed: Jul. 16, 1980

[30] Foreign Application Priority Data

Jul. 25, 1979 [JP] Japan ..... 54-95233

[51] Int. Cl.[3] ..... G03C 7/00; G03C 1/40

[52] U.S. Cl. ..... 430/372; 430/377; 430/382; 430/449; 430/512; 430/544; 430/546; 430/548; 430/554; 430/957

[58] Field of Search ..... 430/377, 493, 382, 372, 430/512, 546, 601, 610, 449, 544, 548, 554, 957

[56] References Cited

U.S. PATENT DOCUMENTS 2,322,027 12/1940 Jelley et al. .
3,258,338 6/1966 Claeys et al. .
3,544,336 12/1970 Milton ..... 430/610
3,554,755 1/1971 Rinauro .
3,676,137 7/1972 Mizuki et al. ..... 430/377
4,220,711 9/1980 Nakamura et al. ..... 430/546

FOREIGN PATENT DOCUMENTS 48-32727 8/1973 Japan .

*Primary Examiner*—J. Travis Brown
*Attorney, Agent, or Firm*—Finnegan, Henderson, Farabow, Garrett & Dunner

[57] ABSTRACT

A silver halide photographic material containing a solution of a 5-pyrazolone type magneta coupler and a high-boiling organic solvent of the formula:

$$R_3-\overset{\overset{\displaystyle O}{\|}}{\underset{\underset{\displaystyle OR_2}{|}}{P}}-OR_1$$

wherein $R_1$, $R_2$ and $R_3$ each represent an aliphatic or aromatic group with a carbon atom of $R_3$ directly bonded to the phosphorus atom.

8 Claims, No Drawings

LIGHT-SENSITIVE SILVER HALIDE PHOTOGRAPHIC MATERIALS

This invention relates to light-sensitive silver halide photographic materials in general and more particularly to light-sensitive silver halide color photographic materials, wherein hydrophilic colloidal solutions for forming constitutive layers of said photographic materials are individually incorporated with a variety of oil-soluble photographic additives, such as photographic couplers or the like, each being dissolved and dispersed in high boiling organic solvents.

In the course of preparing light-sensitive silver halide photographic materials of every kind, various photographic additives are incorporated into hydrophilic colloidal solutions for forming constitutive layers of said photographic materials. In a process of incorporating such photographic additive into hydrophilic colloidal solution, generally the additive previously dissolved in water or a solvent therefor, such as an organic solvent, is added to said solution. In point of its ability as a solvent without ill effect on photographic characteristics, etc. of the resulting light-sensitive silver halide photographic material, water is the best for dissolving photographic additives for the incorporation thereof into said photographic material. Generally, however, numerous photographic additives are difficultly soluble in water, and for dissolving such additives there are used lower alcohols, such as methanol, ethanol, etc., acetone or mixtures thereof with water. However, there are a good many of photographic additives which are also difficultly soluble even in such organic solvents as mentioned above. Typical of these so-called oil-soluble photographic additives are, for example, couplers, DIR compounds, ultraviolet absorbers, photofading inhibitors, color staining inhibitors, etc. As one of processes for incorporating such oil-soluble photographic additives into layers constituting light-sensitive silver halide photographic materials, such as silver halide emulsion layers, auxiliary layers and the like, it is known to incorporate into coating solutions for such constitutive layers the additives in the form of a dispersion comprising fine droplets consisting of an organic solvent immiscible with water, in which fine droplets said additives have individually been dissolved as solute. Such organic solvents as may be used for the above purpose are desired to meet the following requirements. That is, the organic solvent is such that it is miscible with oil-soluble photographic additives, preferably it is substantially capable of dissolving the oil-soluble photographic additives and also capable of permeating into developing solutions, that it does not bring about crystallization of the oil-soluble photographic additive contained therein to cause precipitation or aggregation thereof and is capable of keeping the aforesaid small droplets stably dispersed, that it has a refractive index which is as close as possible to that of a hydrophilic binder in which it has been dispersed, and that it does not soften or weaken layers in which it is to be contained by dispersion and also does not deteriorate the layers in physical properties.

As organic solvents used for dispersing and containing oil-soluble photographic additives in the form of fine droplets thereof in constitutive photographic layers, there have heretofore been known a variety of high boiling organic solvents as disclosed in U.S. Pat. Nos. 2,322,027 and 3,554,755. By way of example, there may be mentioned, for example, phthalates of methyl, ethyl, butyl, benzyl, nonyl and decyl, benzoates of benzyl, butyl-o-methoxy and n-hexyl, triphenyl phosphate, tricresyl phosphate, p-toluenesulfonyldimethylamide, benzophenone, acetophenone, tetrahydrofurfuryl succinate, ethyl succinate, ethanolamine and the like.

However, all oil-soluble photographic additives are not always excellently soluble in the above-mentioned high boiling organic solvents. For instance, couplers or some additives are poor in dispersion stability when they are dispersed by the use of such high boiling organic solvents, and they tend to crystallize or bring about aggregation thereof at any stage of process steps, for example, when they are subjected to emulsification and dispersion by means of a colloid mill or homoblender, while they are on standing after having been incorporated into emulsions or gelatin solutions, and at the time of their being coated and dried, thereby causing sometimes uneven coating and deterioration in image quality. Furthermore, high boiling organic solvents capable of sufficiently dissolving couplers, ultraviolet absorbers or the like additives are generally not always favorable in dispersion stability. Of the conventionally used high boiling organic solvents, some are found poor in dispersion stability even though they have high dissolving power, and on that account such solvents often bring about crystallization aggregation thereof at any stage of the process steps as aforesaid.

In recent years, the conventionally used high boiling organic solvent often throw a hindrance from coloration of couplers in some cases where a strict condition control of the developing treatment of exposed photographic materials at high temperatures with rapidity as well as of the treatment free from environmental pollution is increasingly required.

The use of alkyl phosphate ester high boiling solvents as disclosed in Japanese Patent Publication No. 32727/1973 is known for the purpose of obviating the above-mentioned drawbacks associated with the prior art, wherein a further improvement in color purity is intended by the reduction of subabsorption in red light region resulting from shifting the principal absorption wavelength of magenta forming dyes to a shorter wavelength. In the use of these alkyl phosphate ester solvents as the high boiling solvents for aldehydebis type 5-pyrazolone magenta couplers, however, there is certainly obserbed an improved high ability to dissolve the couplers or the alleged effect obtained by shifting the principal wavelength of the magenta forming dyes to the shorter one. On the other hand, there are brought about such drawbacks that stability of the couplers during development treatment is not satisfactory and unexposed photographic films having contained therein the couplers are found poor in storage stability, and a hindrance for coloration by the coupler is brought about.

Accordingly, a first object of the present invention is to provide light-sensitive silver halide photographic materials wherein the oil-soluble photographic additives intended to be used can stably be contained in hydrophilic colloid liquid without coagulation used for constituting layers on said photographic materials while dispersing said photographic additives in said colloid solution.

A second object of the present invention is to provide light-sensitive silver halide color photographic materials wherein color developability of the couplers used has been improved without formation of fog.

A third object of the present invention is to provide light-sensitive silver halide color photographic materials wherein the color images formed thereon have been improved in stability during storage (fastness to light, heat and humidity).

A fourth object of the present invention is to provide light-sensitive silver halide color photographic materials wherein the colored dyes formed by means of 5-pyrazolone magenta couplers have been improved in spectral absorption property.

A fifth object of the present invention is to provide light-sensitive silver halide color photographic materials wherein stability during development treatment of aldehydebis type 5-pyrazolone magenta couplers has been improved.

A sixth object of the present invention is to provide light-sensitive silver halide color photographic materials containing aldehydebis type 5-pyrazolone magenta couplers with an improved stability.

In the present invention the oil-soluble photographic additives are dissolved by the use of a compound represented by the following general formula, then the obtained solution is dispersed into hydrophilic colloid liquid which is incorporated in constituting layers of light-sensitive silver halide photographic materials.

General formula [I]

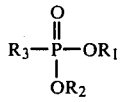

In the formula $R_1$, $R_2$ and $R_3$ each represent an aliphatic or aromatic group (e.g. carbocyclic rings, heterocyclic rings, etc.), and $R_3$ shows that the carbon atom thereof is bonded directly to the phosphorus atom. Preferably, $R_1$, $R_2$ and $R_3$ each represent an alkyl or aryl group and $R_1$, $R_2$ and $R_3$ may be the same or different if the sum total of carbon atoms of $R_1$, $R_2$ and $R_3$ is in the range from 6 to 50. More preferably, $R_1$ and $R_2$ is each an alkyl, acyl, alkoxyalkyl, aryloxyalkyl or aryl group of 1 to 20 carbon atoms, each of these substituents may be further substituted by other substituent. $R_3$ may be a carbonyloxy- or carbonamido-containing group (e.g. alkoxycarbonylalkyl, acyloxyalkyl, acyloxyaryl, alkylaminocarbonylalkyl, acylaminoalkyl or the like group), alkoxyalkyl, aryloxyalkyl, alkoxyaryl, arylalkyl or acylalkyl.

That is, by virtue of the use of at least one of the compounds represented by the above-mentioned general formula [I], satisfactory dispersion stability can be attained in couplers, ultraviolet absorbers and other oil-soluble photographic additives used in light-sensitive silver halide photographic materials without bringing about unevenness in coating or deterioration in image quality. When the compounds of the general formula [I] are used in the preparation of light-sensitive silver halide color photographic materials, moreover, excellent fastness to light, heat and/or humidity can be imparted to the dye images resulting from color development treatment of said photographic materials.

Some of the conventional couplers and other oil-soluble photographic additives were known to exhibit excellent performances in various points. Nevertheless, they were in most cases difficult to put them to practical use because of being difficultly soluble in and having poor dispersion stability in every high boiling organic solvents hitherto known. However, by virtue of the use of the high boiling organic solvents according to the present invention, such known couplers or oil-soluble photographic additives as having excellent properties as aforesaid have, in fact, come to be satisfactorily used without the least inconvenience, and thus this is a great significance in practical sense of the present invention.

Further, many of the conventionally used high boiling organic solvents are liable to an increased fog formation in the resulting silver halide emulsions or to formation of stain or discoloration in white ground of the uncolored area of the resulting light-sensitive silver halide color photographic after color development. The high boiling organic solvents used in the present invention, however, are in no way suffering from such inconveniences.

Of late years, it has been commonly practiced to make thinner photosensitive layers of light-sensitive silver halide photographic materials in order to improve the photographic materials in their characteristics so as to able to meet high temperature and quick photographic processing techniques to which said materials are inevitably applied. As one of the means of making the photosensitive layers thinner, there is a procedure of reducing the quantity of a high boiling organic solvent to be used in said photosensitive layers. As the result, there were observed many cases where a hindrance to development of color by means of the couplers was brought about owing to the reduction of quantity of the conventionally used high boiling organic solvents for that purpose. In the case of the high boiling organic solvents used in the present invention, however, no such inconvenience is anticipated at all.

Concrete examples of the high boiling organic solvents represented the aforesaid general formula and used in the present invention are exemplified below.

| Compound No. | Formula |
|---|---|
| 1 | $C_{12}H_{25}P(O)(OC_2H_5)_2$ |
| 2 | $C_{12}H_{25}OCH_2CH_2CH_2P(O)(OC_2H_5)_2$ |
| 3 | $CH_3COOCH_2CH_2P(O)(OC_2H_5)_2$ |
| 4 | $(BuO)_2P(O)CH_2COOC_2H_5$ |
| 5 | $EtOCH_2P(O)(OC_3H_7)_2$ |
| 6 | $CH_3COCH_2.C(CH_3)_2P(O)(OC_3H_7(iso))_2$ |
| 7 | $CH_3OCH_2CH_2COCH_2C(CH_3)_2P(O)(OC_2H_5)_2$ |
| 8 | $CH_3O(CH_2)_3COCH(CH_3)CH_2P(O)(OCH_3)_2$ |
| 9 | $C_6H_{13}P(O)(OC_2H_5)_2$ |
| 10 | $C_8H_{17}P(O)(OC_4H_9)_2$ |
| 11 | $C_{10}H_{21}P(O)(OC_4H_9)_2$ |
| 12 | $C_{14}H_{29}P(O)(OCH_3)_2$ |
| 13 | $C_4H_9P(O)(OC_4H_9)_2$ |
| 14 | $C_5H_{11}P(O)(OC_4H_9)_2$ |
| 15 | iso-$C_8H_{17}P(O)(OC_4H_9)_2$ |
| 16 | $CH_3P(O)(O-C_6H_5)_2$ |
| 17 | $CH_3P(O)(OC_3H_7)_2$ |
| 18 | $C_6H_5-CH_2CH=CHCH_2P(O)(OC_2H_5)_2$ |
| 19 | $Cl-C_6H_4-CH_2C(CH_3)=CHCH_2P(O)(OC_2H_5)_2$ |
| 20 | $CH_3P(O)(OC_3H_7)(OC_6H_{13})$ |
| 21 | $C_6H_5-P(O)(OCH_3)_2$ |

-continued

| Compound No. | Formula |
|---|---|
| 22 | 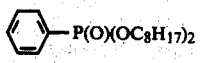 |
| 23 | 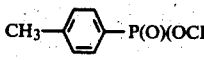 |
| 24 | 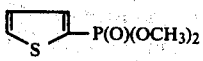 |
| 25 | $C_8H_{17}P(O)(OC_8H_{17})_2$ |
| 26 | $C_2H_5OCO(CH_2)_{10}P(O)(OC_2H_5)_2$ |
| 27 | $C_{12}H_{25}OCO(CH_2)_{10}P(O)(OC_{12}H_{25})_2$ |
| 28 | $C_4H_9CH(C_2H_5)CH_2OCO(CH_2)_{10}P(O)(OC_4H_9)_2$ |
| 29 | $CH_3(CH_2)_7CH(CH_2)_8COOC_2H_5$ <br> $\vert$ <br> $P(O)(OC_2H_5)_2$ |
| 30 | $CH_3(CH_2)_7CH(CH_2)_8COOCH_2CH(C_2H_5)C_4H_9$ <br> $\vert$ <br> $P(O)(OCH_2CH(C_2H_5)C_4H_9)_2$ |
| 31 | $CH_3(CH_2)_7COOCH_2CH_2P(O)(OC_2H_5)_2$ |
| 32 | $CH_3(CH_2)_{12}COOCH_2CH_2P(O)(OC_4H_9)_2$ |
| 33 | $CH_3(CH_2)_5CH-COOC_2H_5$ <br> $\vert$ <br> $P(O)(O-$ 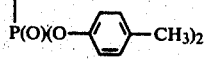 $-CH_3)_2$ |
| 34 | $CH_3(CH_2)_9CHCOOCH_2CH(C_2H_5)C_4H_9$ <br> $\vert$ <br> $P(O)(OC_2H_5)_2$ |
| 35 | $CH_3(CH_2)_5CHCOOC_4H_9$ <br> $\vert$ <br> $P(O)(OC_6H_{13})_2$ |
| 36 | $CH_3(CH_2)_{11}CHCON(C_2H_5)_2$ <br> $\vert$ <br> $P(O)(OC_2H_5)_2$ |
| 37 | $CH_3(CH_2)_5CHCOO-$  <br> $\vert$ <br> $P(O)(OC_2H_5)_2$ |
| 38 | $CH_3-$ 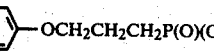 $-OCH_2CH_2CH_2P(O)(OC_4H_9)_2$ |
| 39 | $C_2H_5$ <br> $\vert$ <br> $(C_2H_5O)_2P-CHCOOCH_2CHC_4H_9$ <br> $\Vert$ <br> $OCH_2COOCH_2CHC_4H_9$ <br> $\vert$ <br> $C_2H_5$ |
| 40 | $(C_4H_9O)_2P-CH_2-CHCOOC_4H_9$ <br> $\Vert$ $\quad\quad\quad

For making dispersions of oil-soluble photographic additives by the use of high boiling organic solvents used in the present invention, the following procedure may be taken with satisfactory results. That is, the oil-soluble photographic additive to be dispersed is first dissolved in the high boiling organic solvent according to the present invention to obtain a solution. This solution is then emulsified by means of a colloid mill, homoblender or the like in an aqueous solution of a hydrophilic protective colloid such as gelatin in the presence of a surface active agent, for example, anionic surfactants such as alkylbenzenesulfonic acids, nonionic surfactants, such as saponin or cationic surfactants such as quaternary ammonium salts of alkylamines. Thereafter, the emulsified dispersion thus obtained may be incorporated into gelatino-silver halide emulsions or aqueous solutions of a hydrophilic protective colloid for use for forming auxiliary layers (intermediate, antihalation, protective and the like layers), followed by uniform dispersing. As an alternative thereto, under certain circumstances, the solution of the oil-soluble photographic additive in the high boiling organic solvent may be incorporated directly into coating solutions for use in forming constitutive layers of light-sensitive silver halide photographic materials, followed by emulsifying and dispersing. In the present invention, however, for the purpose of dispersing oil-soluble photographic additives the high boiling organic solvent according to the present invention represented by the aforesaid general formula [I] in combination with other known high boiling solvents, though such dispersing purposes can sufficiently be attained by the use of the present high boiling organic solvent alone. If necessary, the present high boiling organic solvent can be used in combination with low boiling organic solvents used as co-solvents. Usable as low boiling organic solvents in combination with the present high boiling organic solvents, are those as disclosed, for example in U.S. Pat. Nos. 2,801,170, 2,801,171 and 2,949,360. By way of example, such low boiling organic solvents include methyl isobutyl ketone, β-ethoxyethyl acetate, methoxytriglycol acetate, acetone, methyl acetone, methanol, ethanol, acetonitrile, dioxane, dimethylformamide, dimethyl sulfoxide, ethyl acetate, butyl acetate, isopropyl acetate, butanol, chloroform, cyclohexane, cyclohexanol, fluorinated alcohol, etc.

The high boiling organic solvents used for the present invention may be used in any amounts suitably selected according to the couplers, ultraviolet absorbers or other oil-soluble photographic additives. In such case, however, the use of the present high boiling organic solvents in excessively large amounts is undesirable. For instance, in integral multi-layered light-sensitive silver halide photographic materials, when the present solvents are made present in large amounts in an emulsion layer provided at the upper position of said photographic materials and/or ultraviolet absorber containing layer, devellopability of an emulsion layer provided at the lower position of said photographic materials is lowered and, furthermore, emulsion layers and gelatin layers containing the solvents in large excess sometimes are deteriorated in their physical properties. Thus, it is appropriate to use the high boiling organic solvent in such a manner that the weight ratio of the present solvent to each oil-soluble photographic additive is substantially in the range of 0.1 to 8.0.

Hydrophilic colloidal liquid for forming constitutive layers of photographic materials, said colloidal liquid having contained therein oil-soluble photographic additives according to the present invention, are coated on a suitable support, for example, plastic films, resin-coated papers, baryta papers, etc, and then dried.

Gelatino-silver halide emulsions are usually most typical of the silver halide emulsions whch are used for the performance of the present invention. In the present invention, however, there may also be used such silver halide emulsions having used therein acetylated gelatin, phthalated gelatin, water-soluble cellulose derivatives, other hydrophilic synthetic or natural high molecular compounds, or mixtures thereof with gelatin. Even in the case where the aforesaid hydrophilic colloid liquids for forming the constitutive layers photographic materials are used as hydrophilic protective colloid for forming auxiliary layers other than the silver halide emulsions, other protective colloid as aforesaid may be used therein, though gelatin is used commonly.

Couplers usable in the present invention include all of those which are conventionally known as photographic couplers. Preferably usable couplers include, for example, α-benzoylacetanilide type yellow couplers, α-pivaloylacetanilide type yellow couplers, 5-pyrazolone type magenta couplers, pyrazolinobenzimidazole type magenta couplers, phenol type cyan couplers and naphthol type cyan couplers.

The alpha-acylacetamide yellow forming couplers used in the present invention may be synthesized according to procedures respectively disclosed, for example, in West German Laid-Open Patents Nos. 2,057,941 and 2,163,812, Japanese Laid-Open-to-Public Publications Nos. 26133/1972 and 29432/1973, U.S. Pat. Nos. 3,227,550, 2,875,057 and 3,265,506, and Japanese Laid-Open-to-Public Publications Nos. 66834/1973, 66835/1973, 94432/1973, 1229/1974, 10736/1974, 34232/1975, 65231/1975, 117423/1975, 3631/1971 and 50734/1976.

The alpha-acyacetamide yellow forming couplers may be incorporated, either singly or in mixture of two or more, into silver halide emulsion layers, and the incorporation of the coupler in an amount of 5 to 30 mol% per mole of blue-sensitive silver halide can be carried out according to the usual method.

Cyan forming couplers usable in the present invention may be synthesized according to procedures as disclosed, for example, in British Patent Specification No. 1,084,480, Japanese Laid-Open-to-Public Publications Nos. 117422/1975, 10135/1975, 37647/1976, 25228/1975 and 130441/1975. Two equivalent cyan forming couplers are incorporated into silver halide emulsions, either singly or in mixture of two or more, or in admixture with so-called colored couplers, of which the active points have been arylazo-substituted, as disclosed in U.S. Pat. No. 3,034,892. The incorporation of the cyan forming coupler in an amount of 5 to 30 mol% per mole of red-sensitive silver halide can be carried out according to the usual method.

Usable as magenta couplers in the present invention are those illustrated below, but it should naturally be construed that the usable couplers are not limited only thereto.

M-1
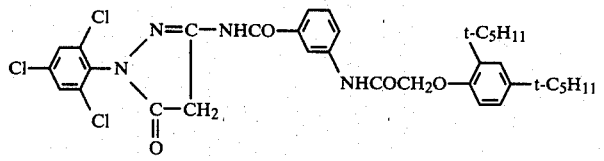
M-2
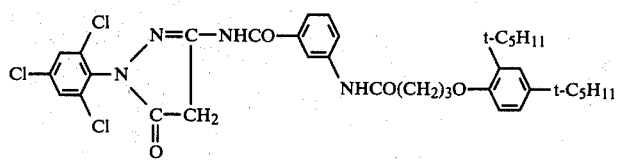
M-3
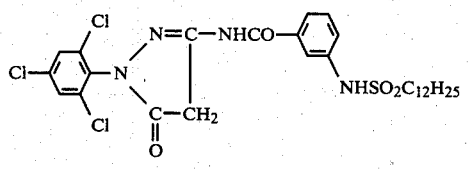
M-4
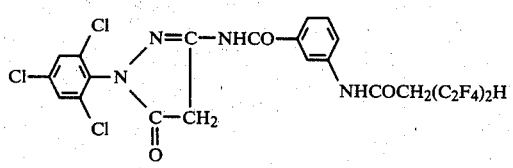
M-5
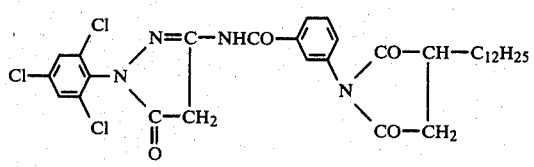
M-6
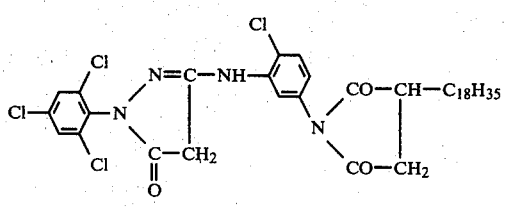
M-7
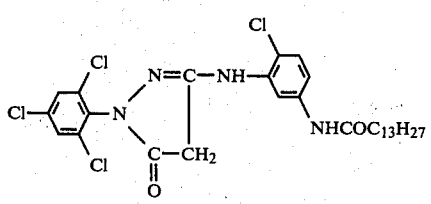
M-8
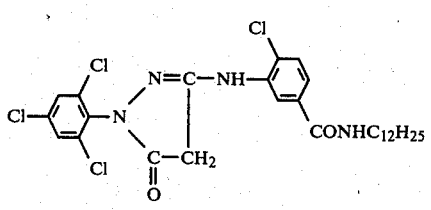

-continued
M-9
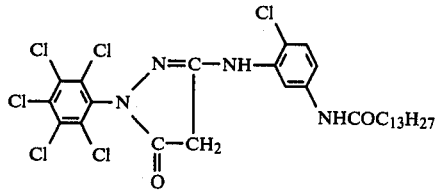
M-10
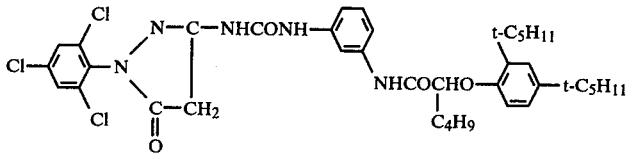
M-11
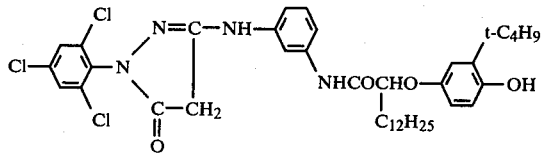
M-12
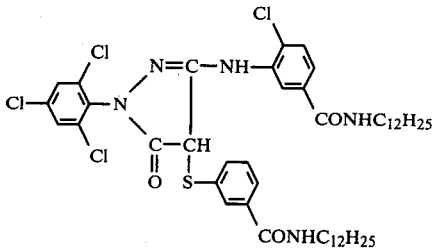
M-13
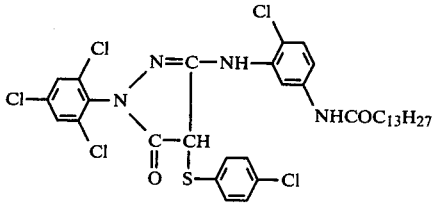
M-14
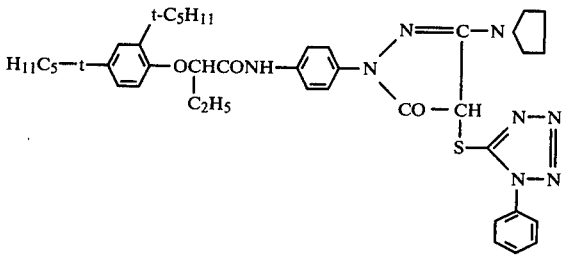
M-15
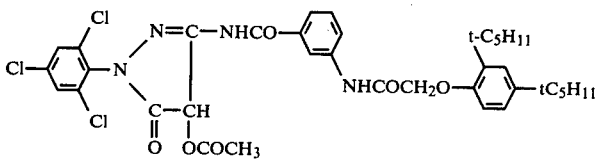
M-16
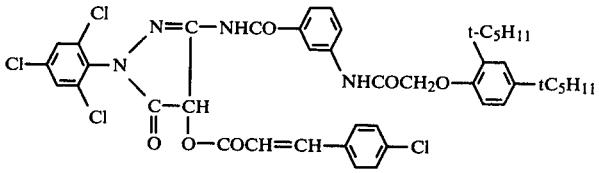

-continued
M-17
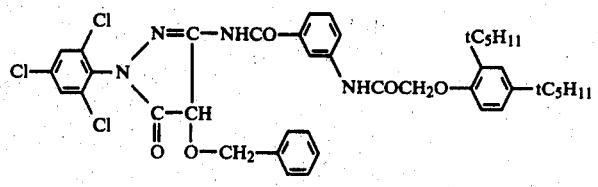
M-18
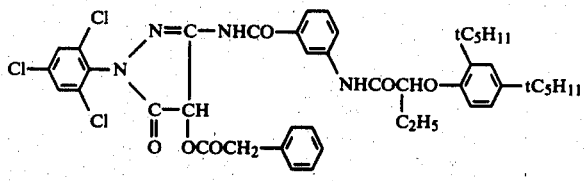
M-19
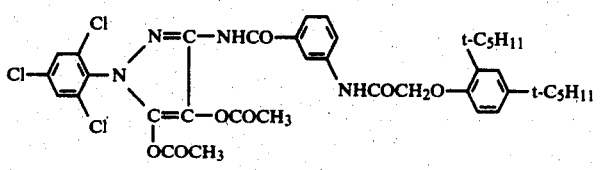
M-20
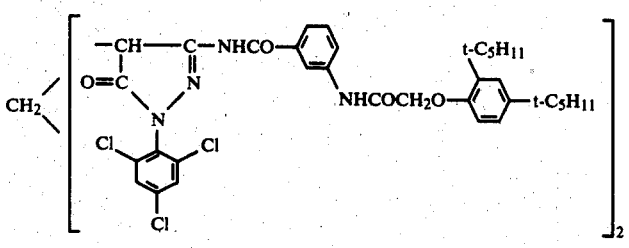
M-21
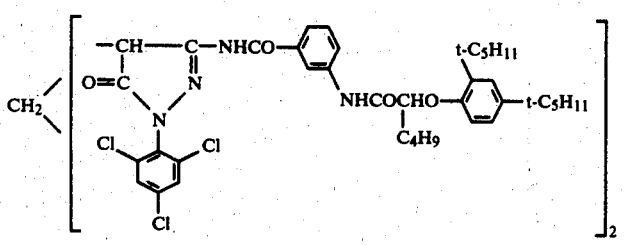
M-22
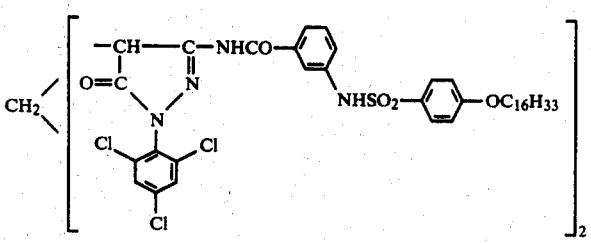
M-23
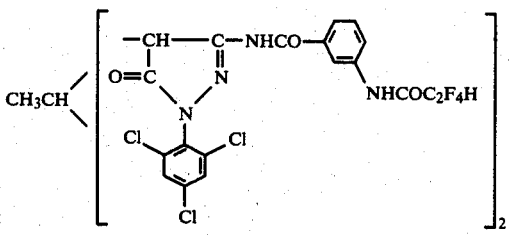

-continued
M-24
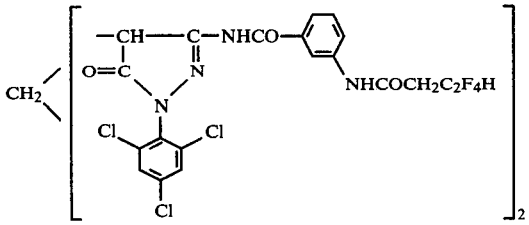
M-25
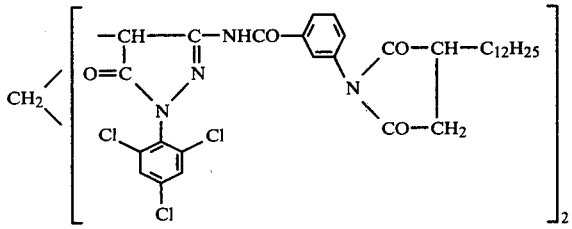
M-26
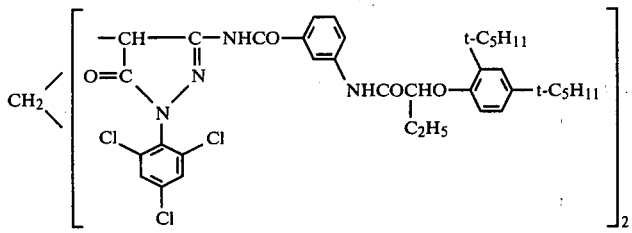
M-27
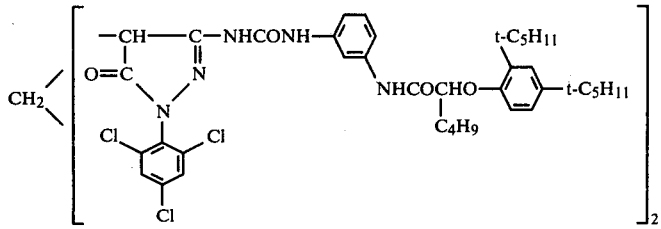
M-28
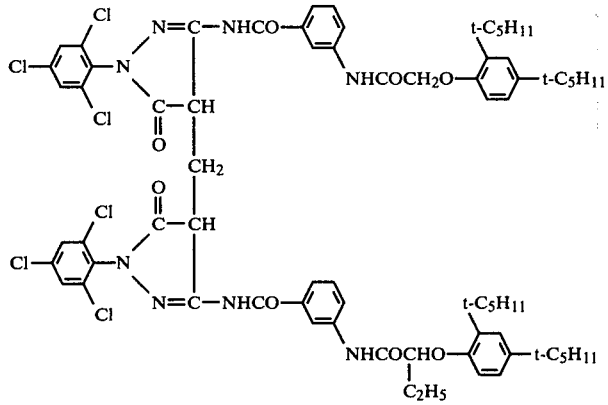

-continued
M-29
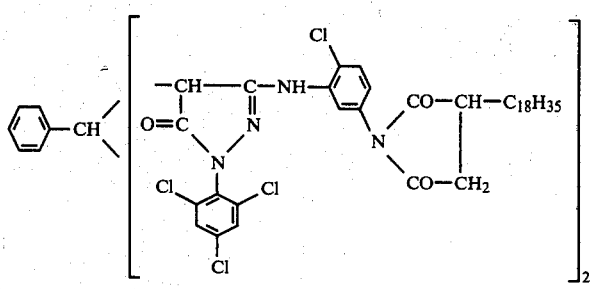
M-30
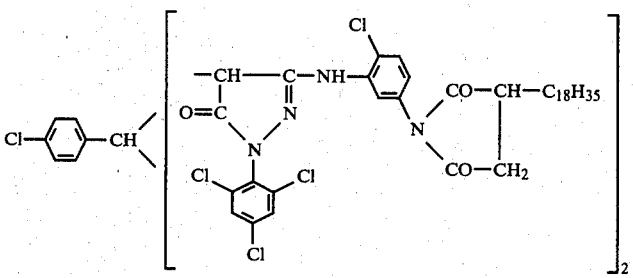
M-31
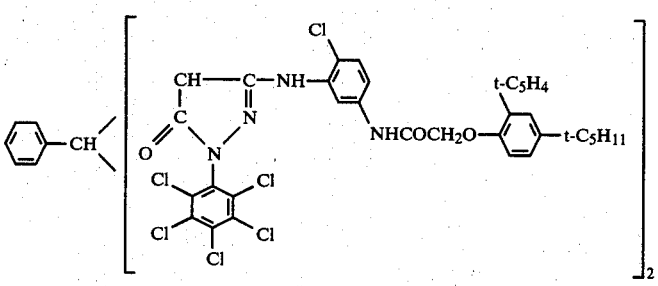
M-32
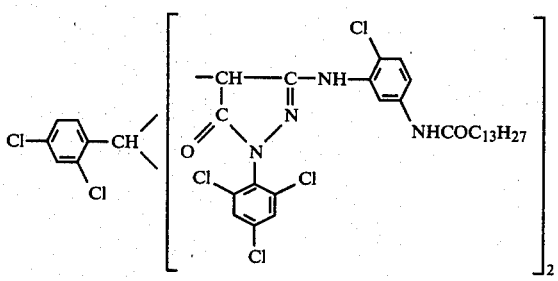
M-33
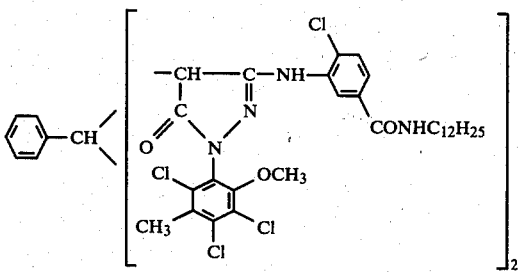

-continued
M-34
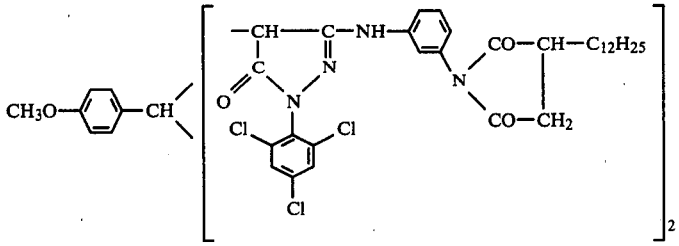
M-35
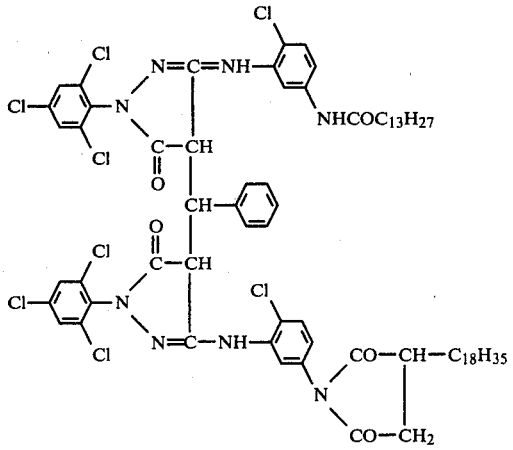
M-36
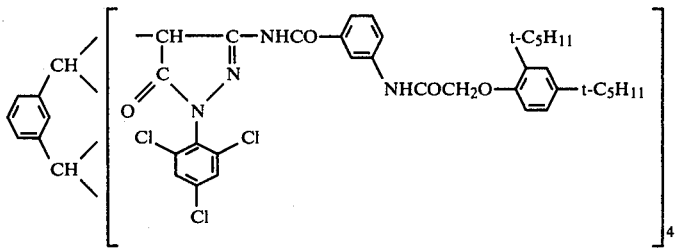
M-37
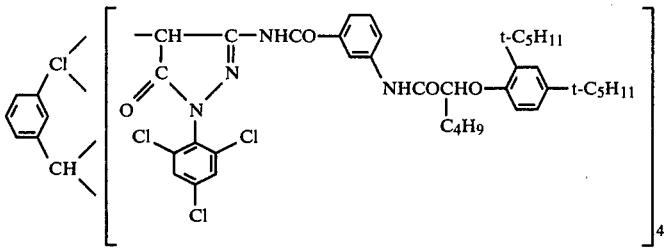
M-38
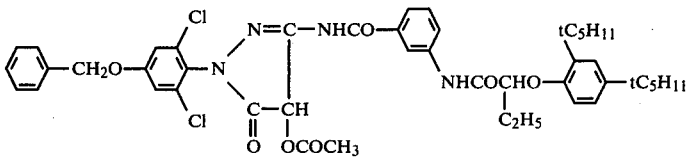

-continued

M-39

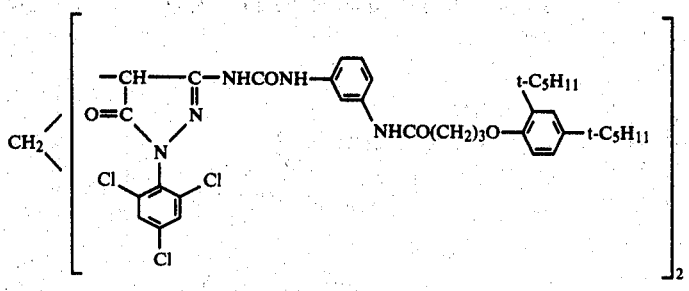

M-40

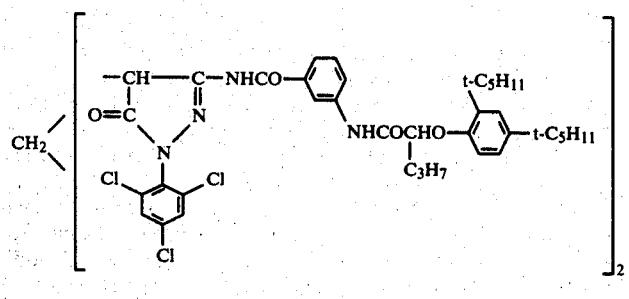

M-41

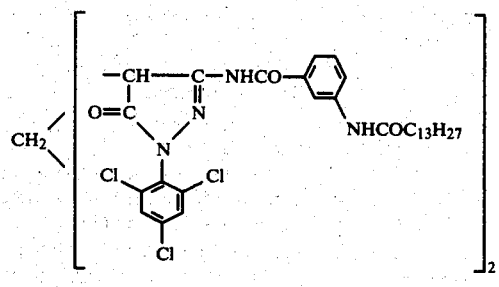

M-42

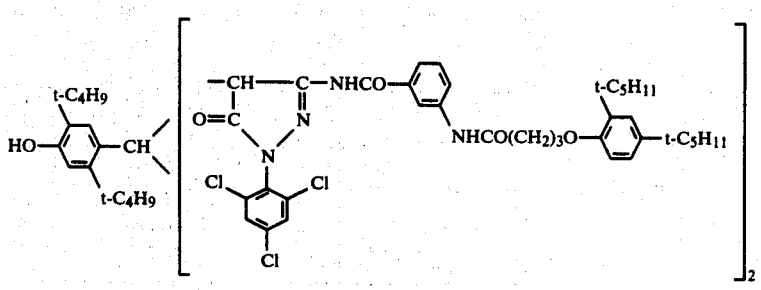

M-43

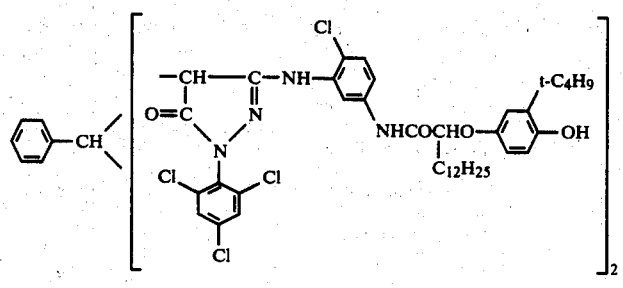

In addition to the magenta couplers as illustrated above, those as usable in the present invention further include such couplers as disclosed, for example, in U.S. Pat. Nos. 3,311,476, 3,419,391 and 3,888,680, West German Patent (OLS) Nos. 2,357,102 and 2,357,122, and Japanese Laid-Open-to-Public Publications Nos. 129538/1974, 23279/1975, 23280/1975, 21687/1975, 127728/1975 and 134470/1975, said couplers may be prepared according to procedures disclosed in these publications, respectively.

The magenta forming couplers used in the present invention may be incorporated into silver halide emulsions, either single or in mixture of two or more, or in admixture with so-called colored couplers, of which the active points have been arylazo-substituted, as disclosed in U.S. Pat. No. 3,005,712. The incorporation of the magenta coupler in an amount of 1 to 25 mol% per mole of green-sensitive silver halide can be carried out in the usual way.

Usable as oil-soluble photographic additives other than the couplers in the present invention are those as will be mentioned hereinafter.

Usable in the present invention as DIR compounds (compounds which produce colorless products on coupling with oxidized color developing agents) are those disclosed, for example, in U.S. Pat. Nos. 3,632,345 and 3,928,041, Japanese Laid-Open-to-Public Publications Nos. 77635/1974, 104630/1974, 36125/1975, 15273/1975, 6724/1976, 23344/1977 and 147716/1975, and Japanese Patent Application No. 2551/1979.

Color stain inhibitors used in the present invention are compounds which are employed for the purpose of inhibiting fog or stain resulting often from unnecessary reaction between oxidized color developing agents resulting from air oxidation and couplers, and these compounds are disclosed, for example, in U.S. Pat. Nos. 2,336,321, 2,360,290, 2,403,721, 2,701,197, 2,728,659 and 3,700,453, British Patent No. 891,158, and Japanese Patent Application No. 2551/1979.

As photofading inhibitors for color dyes used in the present invention, there are those as disclosed, for example, in U.S. Pat. Nos. 3,432,300 and 3,573,050, Japanese Patent Publications Nos. 20977/1974, 31256/1973 and 31625/1973, Japanese Laid-Open-to-Public Publications Nos. 17729/1978 and 48538/1979.

Ultraviolet absorbers used in the present invention include benzotriazoles or benzophenone type compounds as disclosed, for example, in U.S. Pat. Nos. 3,004,896, 3,253,921 and 3,705,805, Japanese Laid-Open-to-Public Publications Nos. 41572/1973 and 25337/1975.

The technique as achieved according to the present invention is applicable to light-sensitive color negative materials, color reversal photosensitive materials, color direct positive photosensitive materials, color paper photosensitive materials, photosensitive materials for instant photography according to DTR process, color X-ray photosensitive materials and black-and-white photosensitive materials. Furthermore, in the case where developers, antioxidants or filter dyes are used, the technology according to the present invention is also applicable to unconventional photosensitive materials.

Color photosensitive materials to be prepared according to the present invention may be used as silver halide saving type photosensitive materials as disclosed in West German Patent (OLS) No. 2,357,964 or the like. In processing such photosensitive materials in which the silver halide used has been saved, applicable is a development treatment process as disclosed, for example, in U.S. Pat. Nos. 2,623,822 and 2,814,565, where after halogenation bleaching the developed silver formed by color development, color development is again carried out to increase the dyes formed thereby in amount, a development treatment process using peroxides or utilizing color amplification by the use of cobalt complex salts, or the like development treatment processes.

The present invention is illustrated hereinafter with reference to examples, but it should not be construed that the scope of the invention is limited only thereto.

EXAMPLE 1

A solution was obtained by dissolving 5 g of a yellow coupler of the following formula in a mixture of 5 g of the present high boiling solvent (35) and 10 g of ethyl acetate while heating the mixture at 70° C. Yellow coupler used:

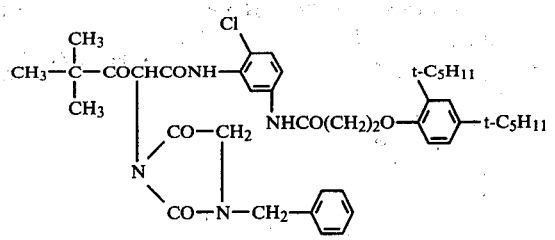

The solution thus obtained was then incorporated into 60 ml of a 5% gelatin solution containing 0.3 g of sodium dodecylbenzenesulfonate, followed by emulsification dispersing by means of a colloid mill, whereupon a homogeneous and finely emulsified dispersion of the coupler in the solvent was obtained.

Subsequently, the emulsified dispersion thus obtained was incorporated in its entirety into 200 g of a blue-sensitive silver chlorobromide emulsion, followed by addition thereto of a stabilizer and a hardener, and then coated on a baryta paper resin coated with polyethylene to obtain sample 1.

Samples 2 and 3 were obtained by repeating the same procedure as above, except that in place of the present high boiling solvent (35), there were used the present high boiling solvents (34) and (1), respectively. Sample 4 was obtained by repeating the same procedure as above but using the same amount of tricresyl phosphate in place of the present high boiling solvent (35).

Samples 1 through 4 were exposed to light through an optical wedge of the staircase type for sensitometry and then subjected to development treatment in the following manner.

| Color development treatment (31° C.) | Treatment time |
|---|---|
| Color development | 3 minutes |
| Bleach-fixing | 1 minute |
| Water-washing | 2 minutes |
| Stabilization | 1 minute |
| Water-washing | 10 minutes |
| Drying (below 95° C.) | |

Processing solutions used in the steps of the above treatment had their respective compositions as mentioned below.

| Composition of color developer solution: | |
|---|---|
| N—Ethyl-N—β-methanesulfonamidoethyl-3-methyl-4-aminoaniline sulfate | 4.0 g |
| Hydroxylamine | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average polymerization degree: 400) | 3.0 ml |
| Water to make 1 liter and adjusted to pH 10.0 with sodium hydroxide. | |

| Composition of bleach-fixing solution: | |
|---|---|
| Iron sodium salt of ethylenediamine-tetraacetic acid | 60.0 g |
| Ammonium thiosulfate | 100.0 g |
| Sodium bisulfite | 10.0 g |
| Sodium metabisulfite | 3.0 g |

-continued

| | |
|---|---|
| Water to make 1 liter and adjusted to pH 6.6 with ammonia water. | |
| Composition of stabilization solution: | |
| Succinic acid | g |
| Formalin (37% aqueous solution) | ml |
| Water | 800 ml |
| Adjust the pH to 3.9 with sodium acetate and then bring the solution up to 1 liter with the addition of water. | |

On the other hand, the exposed samples 1 through 4 were subjected to development treatment in the same manner and same conditions as above, except that in the step of color development, the color developer solution from which the benzyl alcohol had been excluded was used.

Yellow images respectively obtained on the thus processed samples were measured in speed, fog and maximum density (Dmax) by means of a densitometer (Model KD-7R, manufactured by Konishiroku Photo Industry Co., Ltd.) to obtain the results as shown in table 1, wherein the speed was represented by a relative value as measured by assuming as 100 the speed of sample 4 containing the comparative high boiling solvent (TCP) and processed with the color developer solution containing 10.0 ml of benzyl alcohol.

TABLE 1

| Sample No. | High boiling solvent | Benzyl alcohol 10 ml/l | | | Benzyl alcohol 0/1 | | |
|---|---|---|---|---|---|---|---|
| | | Speed | Fog | Dmax | Speed | Fog | Dmax |
| 1 | Exemplified compound 35 | 125 | 0.08 | 2.96 | 83 | 0.06 | 2.56 |
| 2 | Exemplified compound 34 | 128 | 0.07 | 2.90 | 85 | 0.06 | 2.48 |
| 3 | Exemplified compound 1 | 115 | 0.07 | 2.80 | 75 | 0.06 | 2.30 |
| 4 | Comparative compound (TCP) | 100 | 0.08 | 2.70 | 45 | 0.05 | 1.75 |

From table 1, it is understood that in the benzyl alcohol-containing color development treatment, samples 1 through 3 comprising the present high boiling solvents were found to be superior in color developability to sample 4 comprising the comparative high boiling solvent (TCP). Even in the color development treatment where no benzyl alcohol was used, moreover, the present samples 1 through 3 apparently increased in color developability as compared with the comparative sample 4, and thus it is understood that light-sensitive color photographic materials comprising the present high boiling solvents are less dependent in their developability on the use of benzyl alcohol in color developer solutions.

Furthermore, from the fact that the samples 1 and 2 greatly increased in color developability by comparison with the sample 3, it is understood that even in the present high boiling solvents, those having substituted alkyl groups are superior to those having unsubstituted alkyl groups so far as color developability is concerned.

Separately, the samples 1 through 4 processed with the benzyl alcohol-containing developer solution were subjected for 8 days to irradiation by means of a xenon fade-o-meter to investigate light fastness of color images formed on the samples, respectively. The results obtained were as shown in table 2, wherein the evaluation of light fastness was represented by percent residual dye as measured at the initial density 1.0 and by percent residual dye as measured after the light fastness test at the Dmax area of each color image.

TABLE 2

| Sample | High boiling solvent | Initial density (1.0) % residual dye | Initial density (Dm) % residual dye |
|---|---|---|---|
| 1 | Exemplified compound 35 | 88 | 90 |
| 2 | Exemplified compound 34 | 90 | 87 |
| 3 | Exemplified compound 1 | 85 | 85 |
| 4 | Comparative compound (TCP) | 75 | 75 |

As is clear from table 2, it is understood that the samples 1 through 3 comprising the present high boiling solvents are greatly improved in light fastness in comparison with the sample 4 comprising the comparative high boiling solvent (TCP).

EXAMPLE 2

Using the present exemplified compound (M-2) as a magenta couple, emulsified coupler dispersions were individually prepared as prescribed below.

| | |
|---|---|
| Magenta coupler | 10 g |
| Photofading inhibitor* | 3 g |
| High boiling organic solvent | 10 g |
| Ethyl acetate | 20 g |
| Sodium dodecylbenzenesulfonate | 0.3 g |
| 5% gelatin solution | 60 ml |

*Photofading inhibitor 1,4-di-octyloxy-2,5-dipentylbenzene

That is, each emulsified dispersion was prepared by dissolving the magenta coupler and photofading inhibitor in a mixture comprising each of the under-mentioned high boiling organic solvents and ethyl acetate while heating the mixture at 70° C. and emulsifying and dispersing the resulting solution in a 5% gelatin solution containing sodium dodecylbenzenesulfonate by means of a colloid mill. The whole of the emulsified dispersion was incorporated into 200 g of a green-sensitive silver chlorobromide emulsion, followed by addition thereto of a stabilizer and a hardener, and the emulsion was coated on a baryta paper resin-coated with polyethylene and then dried.

[High boiling organic solvent used]

Exemplified compounds (39) (32) (9)

Comparative compounds (A): Dibutyl phthalate (DBP)

Comparative compounds (B): Triamyl phosphate (TAP)

Samples 5 through 9 obtained in the above manner were exposed to light and then subjected to development treatment in the same way as in Example 1 to obtain magenta images on the samples, respectively. The samples thus processed were subjected to irradiation for 8 days by means of a xenon fade-o-meter to investigate light fastness of the color image and yellow stain of the uncolored portion. Further, the samples thus color developed were individually measured in spectroreflectance by means of a spectrophotometer (manufactured by Hitachi, Ltd.), the measured value of spectroreflectance was converted into to measure spectral absorption property, whereby values of adsorption maximum and red light adsorption were determined.

TABLE 3

| Sample | High boiling solvent | Light fastness: Initial density (1.0) % | Light fastness: Stain | Absorption maximum | Absorption of red light (Dλ/Dmax): λ = 600nm | Absorption of red light (Dλ/Dmax): λ = 620nm |
|---|---|---|---|---|---|---|
| 5 | Exemplified compound 39 | 85 | 0.19 | 550 | 0.39 | 0.22 |
| 6 | Exemplified compound 32 | 83 | 0.20 | 549 | 0.38 | 0.21 |
| 7 | Exemplified compound 9 | 86 | 0.24 | 550 | 0.39 | 0.22 |
| 8 | Comparative compound (DBP) | 72 | 0.28 | 555 | 0.45 | 0.25 |
| 9 | Comparative compound (TAP) | 83 | 0.23 | 551 | 0.40 | 0.22 |

From table 3, it is understood that as compared with sample 8 comprising the comparative compound (DBP), samples 5 through 7 comprising the present high boiling solvents and sample 9 comprising the comparative compound (TAP) were distinctly improved in light fastness as well as in stain of the uncolored portion.

It is further understood that as is appreciably different from the case of the comparative sample 9, the dominant wavelength in each of the samples 5–7 and in the comparative sample 8 shifted to a shorter wavelength region, thereby improving distinctly sub-absorption at a wavelength above 600 nm.

EXAMPLE 3

Using a cyan coupler represented by following formula, emulsified coupler dispersions were individually prepapred as prescribed below. Cyan coupler used:

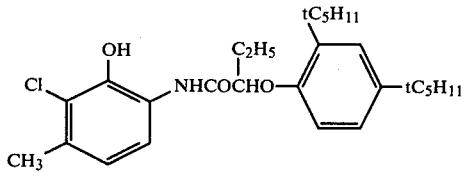

| | |
|---|---|
| Cyan coupler | 5 g |
| High boiling organic solvent | 5 g |
| Ethyl acetate | 10 g |
| Sodium dodecylbenzenesulfonate | 0.3 g |
| 5% Gelatin solution | 60 ml |

That is, each emulsified dispersion was obtained by dissolving the cyan coupler in a mixture comprising each of the under-mentioned high boiling organic solvents and ethyl acetate while heating the mixture at 70° C. and emulsifying and dispersing the resulting solution in a 5% gelatin solution containing sodium dodecylbenzenesulfonate by means of a colloid mill. The whole of the emulsified dispersion was incorporated into 200 g of a red-sensitive silver chlorobromide emulsion, followed by addition thereto a stabilizer and a hardener, and the emulsion was coated on a baryta paper resin-coated with polyethylene and then dried.

[High boiling organic solvent used]

Exemplified compounds (6) (28)

Comparative compound: Dibutyl phthalate (DBP)

Samples 10 through 12 thus prepared were exposed and developed in the same procedure as in Example 1 to obtain colored samples. The colored samples were individually subjected to preservation test for color image after having been stored for 2 weeks at 60° C. and 80% RH and for 2 weeks at 77° C. and dry, respectively, to obtain the results as shown in table 4, wehrein the preservative properties of the color image was expressed in terms of percent residual dye as measured after storage at the initial density=1.0, and the green discoloration degree was represented by the difference (B/R after storage-B/R before storage).

TABLE 4

| Sample No. | High boiling solvent | 60° C. 80% RH (D = 1.0): Residual dye % | 60° C. 80% RH (D = 1.0): B/R | 77° C. Dry (D = 1.0): Residual dye % | 77° C. Dry (D = 1.0): B/R |
|---|---|---|---|---|---|
| 10 | Exemplified compound 6 | 83 | 0.09 | 81 | 0.10 |
| 11 | Exemplified compound 28 | 85 | 0.08 | 83 | 0.11 |
| 12 | Comparative compound (DBP) | 63 | 0.15 | 60 | 0.20 |

As is clear from table 4, it is understood that in comparison with the sample 12 comprising the comparative compound (DBP), the samples 10 and 11 comprising the present high boiling organic solvents, respectively, distinctly improved preservative properties of the color image thereof.

EXAMPLE 4

Using the present exemplified compound (M-20) as a magenta coupler, emulsified coupler dispersions were individually prepared as prescribed below.

| | |
|---|---|
| Magenta coupler | 10 g |
| High boiling organic solvent | 10 g |
| Ethyl acetate | 20 g |
| Sodium dodecylbenzenesulfonate | 0.3 g |
| 5% Gelatin solution | 60 ml |

That is, each emulsified coupler dispersion was obtained by dissolving the magenta coupler in a mixture comprising each of the under-mentioned high boiling organic solvent and ethyl acetate while heating the mixture at 70° C. and emulsifying and dispersing the resulting solution in a 5% gelatin solution containing sodium dodecylbenzenesulfonate by means of a colloid mill. The whole of the emulsified dispersion was incorporated into 200 g of a green-sensitive silver iodobromide emulsion, followed by addition thereto of a stabilizer and a hardener, and the emulsion was coated on a cellulose triacetate film base and then dried.

[High boiling organic solvent used]

Exemplified compounds (22) (32) (33)

Comparative compound (A): Tricresyl phosphate (TCP)

Comparative compound (B): Triacyl phosphate (TAP)

Samples 13 through 17 obtained in the above manner were subjected to exposure to light in the usual way and then color developed according to the following processing steps.

| Processing step (38° C.) | Processing time |
|---|---|
| Color development | 3' 15" |
| Bleaching | 6' 30" |
| Water-washing | 3' 15" |
| Fixing | 6' 30" |
| Stabilization | 1' 30" |

Processing solutions used in the above-mentioned steps had their respective compositions as shown below:

| | |
|---|---|
| [Composition of color developer solution] | |
| 4-Amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Potassium bromide | 1.3 g |
| Nitrilotriacetic acid trisodium salt (monohydrate) | 2.5 g |
| Sodium hydroxide | 1.0 g |
| Water to make 1 liter and adjust to pH 10.0 with potassium hydroxide. | |
| [Composition of bleaching solution] | |
| Iron ammonium salt of ethylene-diaminetetraacetic acid | 100.0 g |
| Diammonium salt of ethylene-diaminetetraacetic acid | 10.0 g |
| Ammonium bromide | 150.0 g |
| Glacial acetic acid | 10.0 ml |
| Water to make 1 liter and adjust pH to 6.0 with ammonia water. | |
| [Composition of fixing solution] | |
| Ammonium thiosulfate (50% aqueous solution) | 152 ml |
| Anhydrous sodium sulfite | 12.4 g |
| Water to make 1 liter and adjust pH to 6.5 with acetic acid. | |
| [Composition of stabilizing solution] | |
| Formalin (37% aqueous solution) | 5.0 ml |
| Konidax (produced by Konishiroku Photo Industry Co., Ltd.) | 7.5 ml |
| Water to make 1 liter. | |

Magenta images obtained respectively on the samples thus developed under the above-mentioned conditions were subjected to sensitometry by means of a densitometer (Model KD-7R manufactured by Konishiroku Photo Industry Co., Ltd.) to obtain the results with respect to speed, fog and maximum density (Dmax) as shown in Table 5, wherein the speed was represented by a relative value as measured by assuming as 100 the speed of the sample 16 comprising the comparative compound (A).

Furthermore, after having been subjected to sensitometry, the developed samples were again subjected to sensitometry in order to investigate dye forming rate of the magenta coupler during the above-mentioned color development treatment, after immersing said developed samples at 20° C. for 5 minutes in a ferricyanide containing bleach bath as prescribed below to obtain the result as shown in table 5, wherein the dye forming rate was represented by a value obtained from the calculation of $$\frac{\text{Dmax as measured after ordinary development treatment}}{\text{Dmax as measured after treatment with ferricyanide bleach bath}} \times 100.$$

| Prescription of ferricyanide bleach bath | |
|---|---|
| $K_3Fe(CN)_6$ | 95 g |
| $K_4Fe(CN)_6$ | 6.5 g |
| Nitrotriacetate | 18 g |
| KBr | 25/1 |

TABLE 5

| Sample No. | High boiling solvent | Speed | Fog | Dmax | Dye forming rate |
|---|---|---|---|---|---|
| 13 | Exemplified compound 22 | 130 | 0.14 | 2.10 | 97 |
| 14 | Exemplified compound 32 | 127 | 0.12 | 2.16 | 98 |
| 15 | Exemplified compound 33 | 123 | 0.12 | 2.08 | 97 |
| 16 | Comparative compound (TCP) | 100 | 0.11 | 1.60 | 72 |
| 17 | Comparative compound (TAP) | 115 | 0.12 | 1.80 | 85 |

As is clear from table 5, it is understood that in comparison with the samples 16 and 17 comprising the comparative compounds TCP and TAP, respectively, the samples 13 through 15 comprising the present high boiling organic solvents are excellent in treatment stability as evidenced by their being high in both speed and Dmax as well as in dye forming rate.

On the other hand, the samples 13 through 17 as prepared, which had remained unexposed, were stored for 3 months under natural conditions (25° C. 60% RH) and thereafter exposed and developed in the same manner as above to obtain their respective colored samples. The colored samples thus obtained were investigated with respect to their preservative properties of raw film in comparison with the samples 13 through 17 as prepared, which had been exposed and developed immediately after preparation thereof. The results obtained were as shown in table 6.

TABLE 6

| Sample No. | Speed: Immediately after preparation | Speed: After storage for 3 months | Dmax: Immediately after preparation | Dmax: After storage for 3 months |
|---|---|---|---|---|
| 13 | 130 | 125 | 2.10 | 2.06 |
| 14 | 127 | 120 | 2.16 | 2.00 |
| 15 | 123 | 126 | 2.08 | 2.20 |
| 16 | 100 | 98 | 1.60 | 1.63 |
| 17 | 115 | 50 | 1.80 | 1.35 |

As is clear from table 6, it is understood that in comparison with the sample 17 comprising the comparative high boiling solvent (B), the samples 13 and 14 comprising the present high boiling solvents, respectively, were markedly improved in preservative properties of raw film.

EXAMPLE 5

Emulsified coupler dispersions were prepared in the same prescription and procedure as in Example 4 using as magenta couplers the present exemplified magenta couplers M-22, M-23, M-27, M-30 and M-41, and the present high boiling solvent compounds (11), (37), (42), (44) and a comparative high boiling solvent (TCP), and the resulting dispersions were individually coated on a support to obtain samples 18 through 22. The samples thus obtained were exposed and developed in the same manner as in Example 4 to investigate Dmax and dye forming rate (dependability on processing solution) of each coupler. The results obtained were as shown in table 7.

TABLE 7

| Sample No. | Present coupler | High boiling solvent | Dmax | Dye forming rate (%) |
|---|---|---|---|---|
| 18 | M-22 | Exemplified compound 11 | 2.23 | 96 |
| 19 | M-23 | Exemplified compound 37 | 2.15 | 97 |
| 20 | M-27 | Exemplified compound 42 | 2.30 | 100 |
| 21 | M-30 | Exemplified compound 44 | 2.28 | 97 |
| 22 | M-40 | Comparative compound (TCP) | 1.65 | 73 |

From table 7, it is understood that the samples 18 through 21 each comprising the present high boiling solvent having dissolved therein the present bis type magenta coupler are all found excellent in color developability as well as in dye forming rate of the coupler.

EXAMPLE 6

Using the present exemplified compound (M-26) as a magenta coupler, emulsified dispersions were prepared according to the following prescription.

| | |
|---|---|
| Magenta coupler | 10 g |
| DIR compound* | 1 g |
| High boiling solvent | 10 g |
| Ethyl acetate | 20 g |
| Sodium dodecylbenzenesulfonate | 0.3 g |
| 5% Gelatin solution | 60 ml |

*DIR compound 2-(1-phenyl-5-tetrazolylthio)-4-(2,4-di-t-amylphenoxyacetamido)-1-indanone That is, each emulsified coupler dispersion of the magenta coupler and the DIR compound was prepared in the same manner as in Example 4, and the resulting dispersion was incorporated into 200 g of a green-sensitive silver bromide emulsion, followed by addition thereto of a stabilizer and a hardener. The emulsion was coated on a cellulose acetate film base and then dried.

[High boiling organic solvent used]

Exemplified compound (11)

Comparative compound: Tricresyl phosphate

Samples 23 and 24 obtained in the above manner were exposed and developed in the same manner as in Example 4 to investigate photographic properties thereof, whereupon the sample comprising the present high boiling solvent showed excellent photographic properties.

What we claim is:

1. A silver halide photographic material having a support and a hydrophilic colloidal layer coated thereon, said hydrophilic colloidal layer containing a solution of (a) a 5-pyrazolone type magenta coupler; and (b) a high-boiling organic solvent having the general formula [I]:

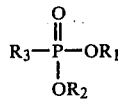

[I]

wherein $R_1$, $R_2$ and $R_3$ each represent an aliphatic or aromatic group and a carbon atom of $R_3$ is bonded directly to the phosphorus atom.

2. A silver halide photographic material having a support and a hydrophilic colloidal layer coated thereon, said hydrophilic colloidal layer containing a solution of (a) an aldehyde-bis 5-pyrazolone type magenta coupler (b) a high-boiling organic solvent having the general formula [I]:

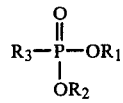

[I]

wherein $R_1$, $R_2$ and $R_3$ each represent an aliphatic or armomatic group and a carbon atom of $R_3$ is bonded directly to the phosphorus atom.

3. The silver halide photographic material of claim 1 or 2 wherein said solvent is dispersed in the hydrophilic colloidal layer.

4. The silver halide photographic material of claim 1 or 2 wherein $R_1$, $R_2$ and $R_3$, which may be the same or different, each represent an alkyl or aryl group, and the sum of carbon atoms of $R_1$, $R_2$, and $R_3$ is in the range from 6 to 50.

5. The silver halide photographic material of claim 3, wherein the substituent $R_3$ has a carbonyloxy- carbonamido- containing group or an alkoxyalkyl, aryloxyalkyl, alkoxyaryl, arylalkyl or acylalkyl group.

6. A process for incorporating an oil-soluble photographic additive into a hydrophilic colloidal solution for forming a photographic colloidal layer, comprising the steps of:

(a) dissolving the oil-soluble photographic additive in a high-boiling organic solvent having the general formula [I]:

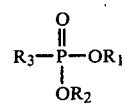

[I]

wherein $R_1$, $R_2$ and $R_3$ each represents an aliphatic or aromatic group, and a carbon atom of $R_3$ is bonded directly to the phosphorus atom, to obtain a first solution; and (b) thereafter incorporating said first solution into said hydrophilic colloidal solution.

7. The process of claim 6 wherein said first solution is dispersed in said hydrophilic colloidal solution.

8. The process of claim 6 wherein said oil-soluble additive is a coupler, a DIR compound, a UV-absorbing agent, a photofading inhibitor or an anti-staining agent.

* * * * *